United States Patent [19]

Bennett

[11] 4,331,111

[45] May 25, 1982

[54] LOW VIBRATION ENGINE

[76] Inventor: Arthur G. Bennett, 543 Auburn Dr., Auburn, Ala. 36830

[21] Appl. No.: 73,802

[22] Filed: Sep. 10, 1979

[51] Int. Cl.[3] ..... F02B 75/32; F02B 75/18

[52] U.S. Cl. ..... 123/192 B; 123/52 A; 123/56 R; 123/56 A; 123/197 R

[58] Field of Search ..... 74/604, 603; 123/52 A, 123/197 AC, 197 R, 192 R, 192 B, 56 R, 56 AC, 56 A

[56] References Cited

U.S. PATENT DOCUMENTS

| | | | |
|---|---|---|---|
| 2,288,820 | 7/1942 | Mas | 123/52 A |
| 3,370,429 | 2/1968 | Brice | 123/52 A |
| 3,390,670 | 7/1968 | Brice | 123/52 A |
| 3,563,222 | 2/1971 | Ishida | 123/192 |

FOREIGN PATENT DOCUMENTS

| | | | |
|---|---|---|---|
| 1282262 | 1/1961 | France | 123/52 A |

*Primary Examiner*—Ronald B. Cox

*Attorney, Agent, or Firm*—Newton, Hopkins & Ormsby

[57] ABSTRACT

A two cylinder twin crankshaft two cycle engine having materially reduced vibration is disclosed, together with a dynamical analysis of the balance criteria from which minimized vibration is derived. The engine is suitable for powering small remotely controlled aircraft for both military and civilian usage.

6 Claims, 4 Drawing Figures

$\varepsilon = r/\ell$

LOW VIBRATION ENGINE

BACKGROUND OF THE INVENTION

In the past few years there have been a number of programs in this country and abroad to develop very small remotely controlled aircraft for both military and civilian use. These craft have been dubbed Mini-Remotely Piloted Vehicles (Mini-RPV's). The low speed (less than 150 knots) and small power requirement (less than 25 hp) for Mini-RPVs dictate that the best propulsion system for such vehicles is a propeller driven by a reciprocating engine.

In many of the Mini-RPV programs attention was focused on the electronics of navigation, guidance and control systems and/or certain special electronic sensors. This attention was necessary because much of the electronics involved new technology. However, it was found that insufficient attention had been paid to the more mundane power plant problem. The several go kart and industrial engines that had been applied to the job were inadequate even with considerable modifications. Reliability, vibration and configuration difficulties had not been surmounted.

The Mini-RPV propulsion problem was recognized over three years ago and in February 1977 the U.S. Army awarded two parallel contracts to develop 20 hp Mini-RPV engines. The present low vibration twin crankshaft engine is the result of work done under one of the above contracts.

Engines of the broad type to which this invention relates are known in the prior art and to comply with the duty of disclosure required by 37 C.F.R. 1.56, the following references are made of record herein: U.S. Pat. Nos. 2,253,490, Bakewell, and 3,332,404, Lovercheck; and July, 1969 issued of Radio Control Modeler, page 35, etc.

SUMMARY OF THE INVENTION

The subject engine is a 20 hp., two cylinder, two cycle, simultaneously firing, twin crankshaft unit with the twin cranks geared to a common output shaft. The cranks run in separate cavities of a common split housing. Induction is by twin carburetors, each feeding through a separate crankshaft mounted rotary valve. In effect, the machine consists of two independent single cylinder engines. The flat design and low profile of the engine are desirable for aircraft use. For economy and practicality, the engine employs a number of standard high production parts. An alternator is mounted on the common output shaft of the engine and can produce 1000 watts at 28 volts D.C. and 5000 RPM to power the electronics onboard the RPV.

The twin crank design was chosen for several reasons. First, the independent cylinders and cranks give a degree of improvement in reliability. Second, the isolated crank cavities and separate carburetors eliminate possible fuel and air distribution problems that can occur with simultaneously firing cylinders fed from a common crankcase. Third, the geared output provides a simple means of matching output speed to propeller and vehicle requirements. This matching capability is important in all but the smallest engines. Above a very few horsepower, the crankshaft speed of efficient two stroke engines is too high for reasonable propeller efficiency.

The fourth reason for the twin crank design is that it offers the best possibility for vibration reduction with only two cylinders. It is obvious that the cylinder axes can be made coincident in this configuration which gives internal cancellation of piston forces and elimination of rocking moment. This idea is not new and engines incorporating this feature have been built before. Such engines have been both of twin crank or "dual" configuration and with single cranks using the classical duplicated throws and rods of Lanchester or the "dog leg" connecting rods of Ross as employed in well-known model airplane engines. What is new in the present engine is a special arrangement of mass and geometry that not only eliminates rocking moment but also materially reduces the overall imbalance frame moment about the axis of the output shaft.

DETAILED DESCRIPTION

Figure 1:
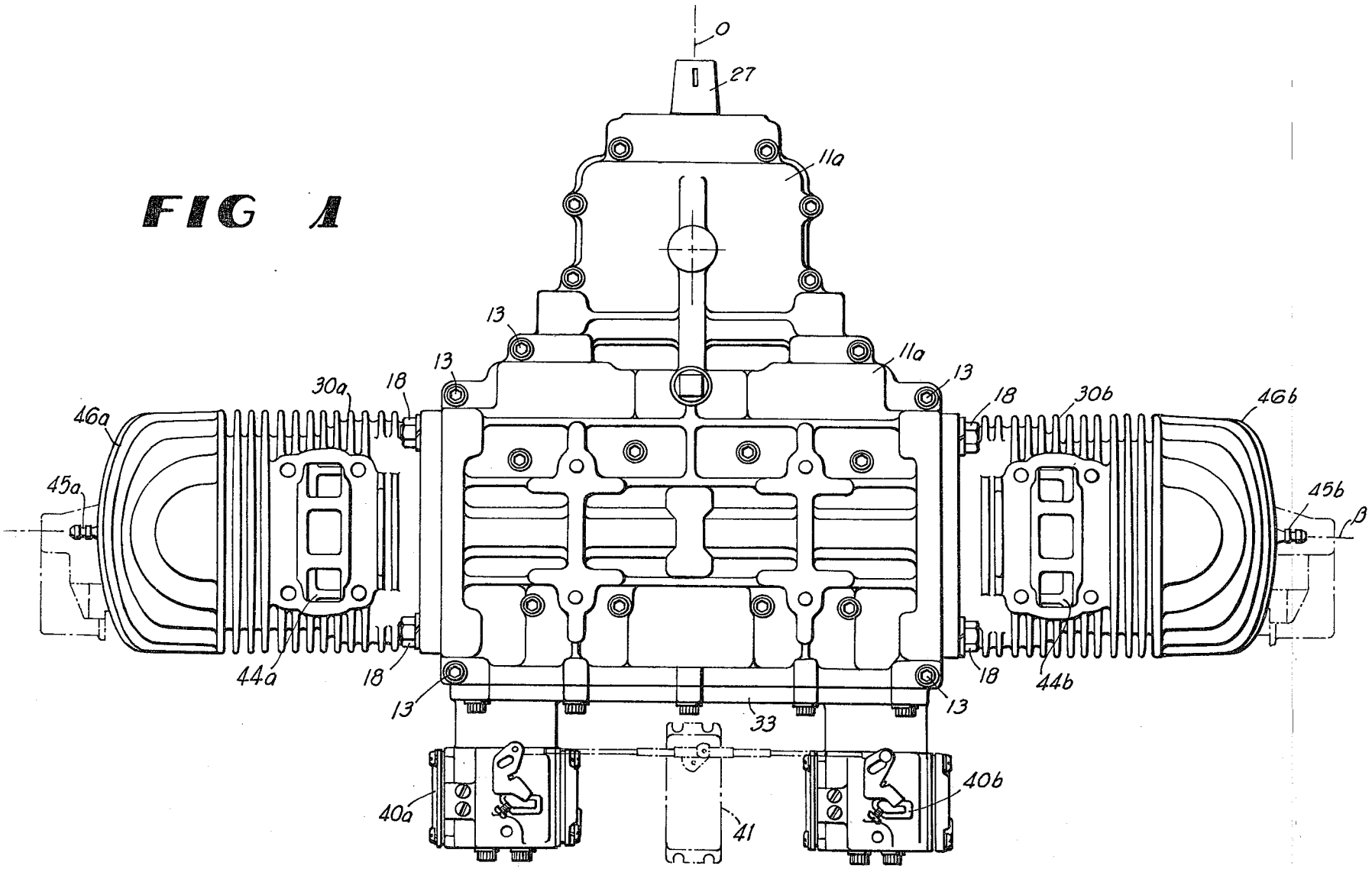
FIG. 1 is a plan view of an engine embodying the invention.
Figure 2:
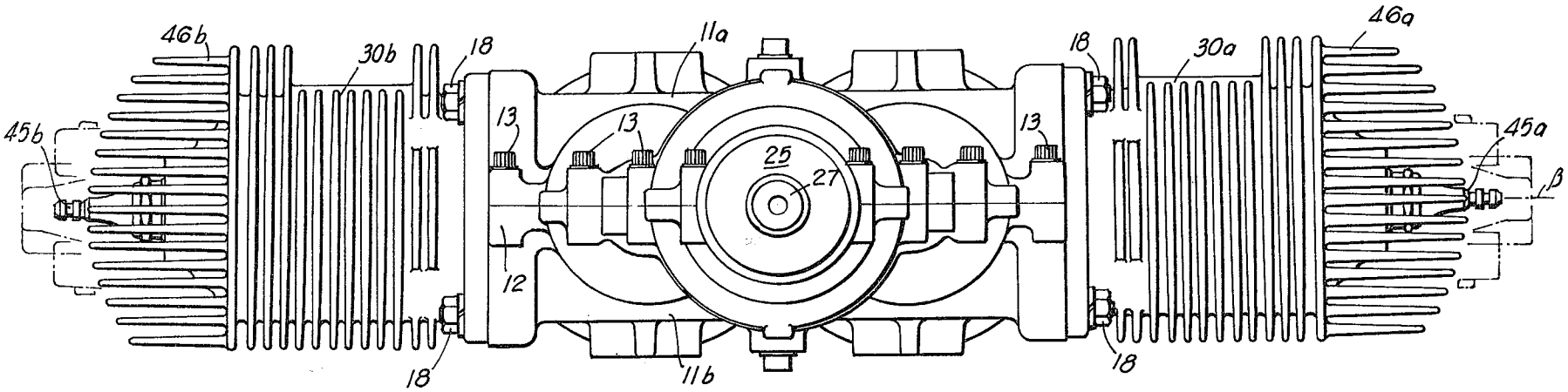
FIG. 2 is an end elevational view thereof taken from the output shaft end.
Figure 3:
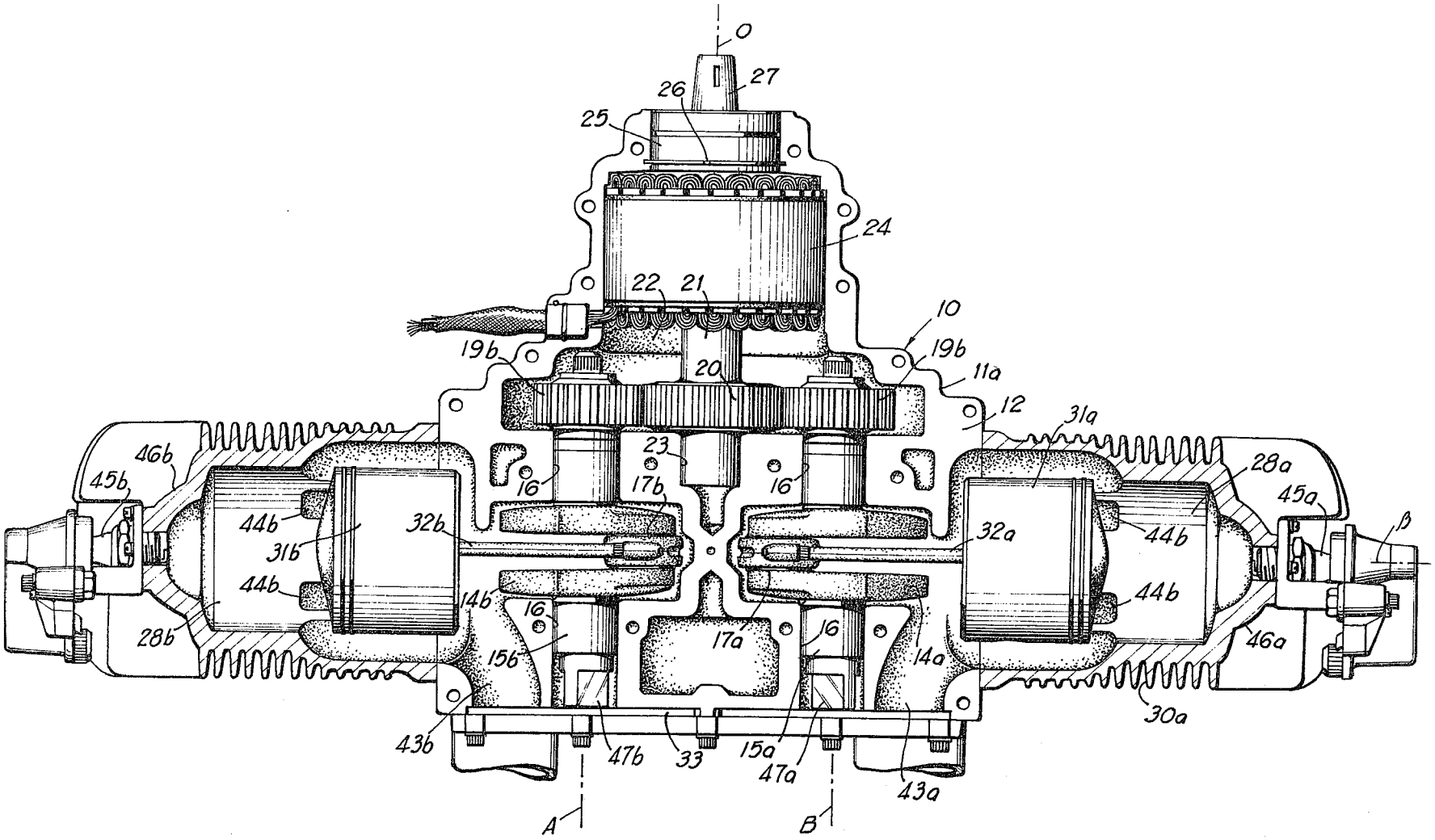
FIG. 3 is a further plan view of the engine, partly in section, with one housing half removed.

Referring now in detail to the embodiment chosen for purpose of illustrating the present invention, numeral 10 denotes generally a central crankcase or engine block, formed of opposed block halves 11*a* and 11*b* having flat surfaces fitted together along a common horizontal plane 12. Bolts 13 retain the two halves 11*a*, 11*b* together.

The engine block 10 is symmetrical, about a longitudinal axis O. These cavities 14*a*, 14*b* respectively receive a pair of opposed, parallel, longitudinally extending twin crankshafts 15*a* and 15*b* appropriately journalled at opposite ends of cavities 14*a*, 14*b* by main crankshaft bearings 16 in the block 10. The crankshafts 15*a*, 15*b* have single central crank arms 17*a*, 17*b* in the cavities 14*a*, 14*b* and the forward end portions of crankshaft 15*a*, 15*b* are provided with spaced gears 19*a*, 19*b* which mesh with and drive a main central drive gear 20 on the inner end portion of a straight main output shaft 21.

Gears 19*a*, 19*b* and 20 are in a closed, symetrical common gear and alternator cavity 22 in the forward portion of the block 10, forwardly of the spaced crankcase cavities 14*a*, 14*b*, the gears 19*a*, 19*b* being on diametrically opposed sides of central gear 20. Thus, the crank arms of crankshafts 14*a*, 14*b* are synchronized at all times.

The output shaft 21 is journalled rearwardly of the gear cavity 22 by main output bearings 23. The central portion of shaft 21 is provided with the rotor of an alternator 24, the stator of which is carried in the cavity 22. Wires 29 passing through the block 10 conducts current from the alternator 24.

Forwardly of the alternator 24 the block 10 carries a thrust bearing 25 having a keeper ring 26. The main shaft 22 protrudes outwardly of the thrust bearing to receive an appropriate propeller (not shown) on its forwardly end portion 27, outwardly of the block 10.

The crankcase cavities 14*a*, 14*b* open outwardly on diametrically opposite sides of block 10 and communicate respectively with the cylindrical chambers 28*a*, 28*b*, of a pair of inwardly opening, opposed finned cylinders 30*a*, 30*b* which are bolted by bolts 18 and along a common transverse axis $\beta$ to the engine block 10. Axis O and $\beta$ intersect perpendicularly to each other.

Within the chamber 28a, 28b are a pair of reciprocating pistons 31a, 31b, connected in conventional manner to the crank arms of crankshafts 15a, 15b by piston rods 32a, 32b.

As shown in FIG. 1, twin carburetors 40a, 40b, connected with a common central servo mechanism 41, supply a fuel mixture through twin induction passages 43a, 43b in the rear portion of block 10 to the cylinder chambers 28a, 28b which have exhaust ports 44a, 44b. Spark plugs 45a, 45b and associated electrical components are mounted at the cylinder heads 46a, 46b of the two cylinders. The fuel mixture from the two carburetors 40a, 40b is supplied through two rotary valves 47a, 47b connected with and driven by the twin crankshafts 15a, 15b.

Other components of the engine, not described, are conventional.

A TWIN CRANK BALANCE CRITERION

Figure 4:
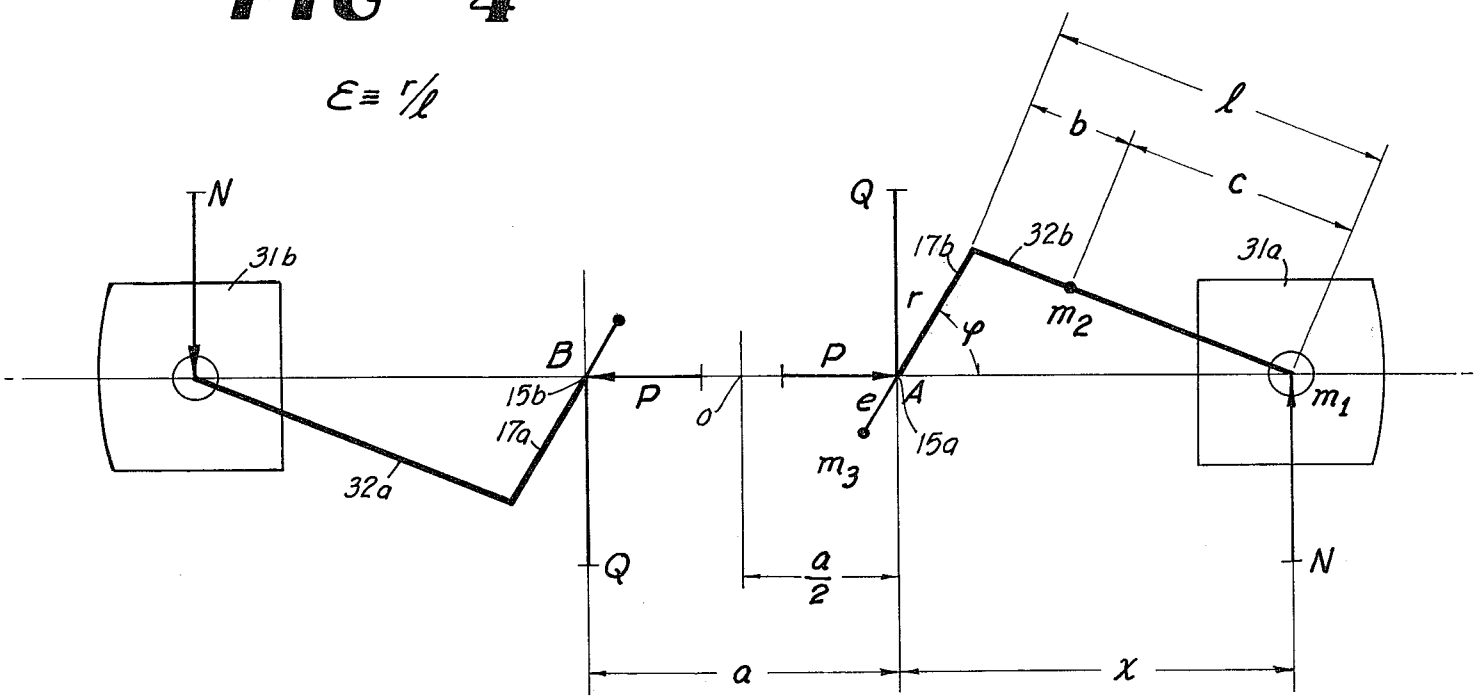
FIG. 4 is a schematic view of the twin crankshaft arrangement.

In FIG. 4, the symbols to be used for the various forces, lengths and angles involved are defined in Table I.

TABLE 1

| | |
|---|---|
| $M_0$ = | moment about the longitudinal axis |
| N-Q = | frame force on a single cylinder |
| $N_x$ = | time rate of change of the angular momentum of the axis |
| k = | connecting rod or piston rod mass center radius of gyration |
| l = | length of the piston rod 32a or 32b |
| $m_1$ = | mass of a piston 31a or 31b |
| $m_2$ = | mass of a piston rod 32a or 32b |
| $m_3$ = | crank mass |
| m* = | mass of the crank balance bob weight |
| l = | length of piston rod 32a or 32b |
| Q = | force perpendicular to axis |
| P = | force along axis $\beta$ on crankshaft 15a or 15b |
| $\alpha$ = | transverse distance between the axes A and B. |
| r = | length of throw of the crank arm 17a or 17b. |
| $\gamma$ = | the angular displacement of the throw arm or crank arm from the transverse axis $\beta$ of the pistons. |
| x = | distance from the center of mass $m_1$ of the piston to its associated crankshaft axis. |
| e = | distance from the center of the crank arm axis to the center of the crank mass $m_3$. |
| b = | distance from the center of the mass $m_2$ of the piston rod 32a or 32b to the axis of the crank arm. |
| c = | distance from the center of the mass $m_1$ of the piston 31a or 31b to the center of the mass $m_2$ of the piston rod 32a or 32b. |
| $\Phi$ = | angular acceleration. |
| .2 = | angular velocity. |
| $c_1$ = | constant (1.008). |
| $c_3$ = | constant (0.024). |
| $c_5$ = | constant (0.001). |
| $\epsilon$ = | r ÷ l |
| a = | crank spacing |

The cranks rotate about axes through A and B and are geared to a common output shaft with axis through O. The two cranks 17a and 17b rotate in the same direction and have relative angular orientation such that the pistons 32a, 32b travel symmetrically opposite. In the two-stroke cycle, the cylinders then fire simultaneously.

The separated crank axes A and B allow the two cylinder axes $\beta$ to be coincident and the rocking moment present in usual single crank designs is absent. From symmetry it is evident that all external force sums are zero. There is, however, an unbalanced moment about O arising from the transverse bearing forces at axes A and B and from the piston side forces. The objective of this invention is to minimize this unbalanced moment.

Summing moments about point O, the following is obtained:

$$\Sigma M_o = (N-Q)a + 2N_x \tag{1}$$

The term (N−Q) is the classical frame force on a single cylinder machine, and $N_x$ is equal the time rate of change of the angular momentum of crank and connecting rod. Expressions for both these terms are given in any thorough discussion of engine dynamics; for example, reference is made to the text entitled "Advanced Dynamics", Stephen Timoshenko and D. H. Young, McGraw-Hill, 1948. Portions of pages 136–143 translated into the present notation yields the following expressions:

$$N - Q = (m_2 b\epsilon - m_3 e)\ddot{\phi}\cos\phi - (m_2 b\epsilon - m_3 e)\dot{\phi}^2 \operatorname{Sin}\phi \tag{2}$$

$$Nx = \dot{\phi}^2 m_2 \epsilon (bc - K^2)(c_1 \operatorname{Sin}\phi - c_3 \operatorname{Sin} 3\phi + c_5 \operatorname{Sin} 5\phi + \ldots) \tag{3}$$

where $\epsilon = r/l$ and k = connecting rod mass center radius of gyration. Eq. 1 then becomes $$\Sigma M_o = [(m_2 b\epsilon - m_3 e)a \operatorname{Cos}\phi]\,\phi - [(m_2 b\epsilon - m_3 e)\,a \operatorname{Sin}\phi - 2m_2\epsilon(bc - k^2)(c_1 \operatorname{Sin}\phi - c_3 \operatorname{Sin} 3\phi + c_5 \operatorname{Sin} 5\phi + \ldots)]\,\dot{\phi}^2 \tag{4}$$

For any usual engine the angular acceleration, $\phi$, is much less than the square of the angular velocity, $\phi^2$. So, it is appropriate to drop the angular acceleration term. The constants $c_1$, $c_3$, $c_5$, . . . depend upon $\epsilon = r/l$. For a reasonable and usual value $\epsilon = 0.25$, Ref. (1) gives $c_1 = 1.008$, $c_3 = 0.024$, $c_5 = 0.001$. And to good approximation we may drop terms multiplied by constants $c_3$, $c_5$, . . . . The moment relation, Eq. 1, becomes $$\Sigma M_o = [(m_3 e - m_2 b\epsilon)a - 2m_2\epsilon c_1(bc - k^2)]\phi^2 \operatorname{Sin}\phi \tag{5}$$

Under the approximations made, the moment is minimum when the term in square brackets in Eq. 5 is zero.

$$(m_2 b\epsilon - m_3 e)a + 2m_2\epsilon c_1(bc - k^2) = 0 \tag{6}$$

This relation can be further simplified if $c_1$ is set to unity. This approximation is most reasonable since the variation of $c_1$ from unity is less than 1% for usual r/l. Then the balance criterion for the twin crank engine is $$(m_2 b\epsilon - m_3 e)a + 2m_2\epsilon(bc - k^2) = 0 \tag{7}$$

Note that this relation contains only the crank mass and the rod mass. Piston mass does not appear.

EXAMINATION OF BALANCE CRITERION

Consider the term $(bc - k^2)$ in Eq. 7. It is a classical result that for this term to be zero, the bearing centers of the connecting rod are conjugate centers of percussion. This situation is obtained by adding appropriate amounts of material to the rod above the upper bearing and below the lower bearing. the design does eliminate transmission of transverse rod forces but is not often done. Since the design of such a rod is easy enough, the teachings of Timoshenko, above-referenced, and C. B. Biezeno and R. Grammel, "Engineering Dynamics," Vol. IV, "Internal Combustion Engines", London & Glasgow: Blackie & Son Limited, 1954, pp. 10–14, are agreed with and it is thought rods with conjugate centers of percussion at the bearings should be considered more often.

As a first step in examination, suppose the rod is conjungate so $(bc-k^2)=0$. Then Eq. 7 requires either $a=0$ or $(m_2b\epsilon-m_3e)=0$.

If the first of these is the case, then the twin crank machine has, in effect, a single crank. It is necessary to have either a double throw crank which reintroduces rocking moment, or some special mechanism such as that of Lanchester or Ross, mentioned previously.

If, instead of $a=0$, $(m_2b\epsilon-m_3e)=0$ is chosen, an interesting result ensues. The classical balance relation which defines the portion or "percent" of balance $\chi$ may be written as follows:

$$\chi Q + Q' = 0,\ 0 \leqq \chi \leqq 1$$

where $$Q = \left(m_1 + m_2\frac{c}{l}\right) r, \tag{8}$$

$$Q' = (m_2b\epsilon - m_3e),$$

Now, $Q'$ is just the term under consideration. If $Q'=0$, then either $\chi=0$ or $Q=0$. But $Q\neq 0$ unless c is negative. This is the case for the extended rod that places rod/piston mass center at the lower end. Such a rod is not only a mechanical monster but also is inconsistent with the assumption of a conjugate rod (and strictly, $\chi$ would be undefined for both Q and Q' zero). So it is concluded $\chi=0$ and a zero balanced engine is obtained if there is a conjugate rod and the twin crank balance criterion is satisfied. Note that in this situation, crank spacing, a, is left to the designer's discretion.

As a second step in examination, Eq. 7 is rewritten in the following form $$m_3e = m_2\epsilon\left[b + \frac{2}{a}(bc - k^2)\right]. \tag{9}$$

Now introduce $m^*$=mass of crank balancing bob weight. Then $$m^*r = m_3e \tag{10}$$

And an expression is found for required bob weight in terms of given engine parameters $$m^* = \frac{m_2}{l}\left[b + \frac{2}{a}(bc - k^2)\right] \tag{11}$$

As a final form for Eq. 7, it is solved for crank spacing as follows:

$$a = \frac{2\,m_2\epsilon\,(bc - k^2)}{m_3e - m_2b\epsilon} \tag{12}$$

This relation gives spacing when other parameters are specified as is the case when the engine is designed around existing cranks and connecting rods.

APPLICATION OF THE BALANCE CRITERION

In the present design, the connecting rod mass and geometry are not free. That is, $m_2$, b, c, and $k^2$ are fixed. And since the crank is made from an existing forging, only small adjustment in r and thus $\epsilon$ is possible. Additionally, the spacing, a, is free only within limits. The smallest value of a is determined by internal crankcase diameter and the minimum wall thickness required between the two crank cavities. A large value of crank spacing, a, simply makes the engine wide, which is undesirable. So, the spacing was chosen to give reasonable wall thickness and to be appropriate for a desired pitch of gears.

With the above parameters fixed, the form of the balance criterion is that given by Eq. 11. The required bob weight, $m^*$, was determined and the crank counterweights designed to match. Of course, a little extra mass was put in the counterweights to allow for fine balancing after machining.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An engine having minimized vibration during normal operation and being balanced according to balance criterion expressed as:

$$(m^2b\epsilon - m_3e)a + 2m\epsilon(bc - k^2) = 0.$$

where:

a=crank spacing m=mass of each piston rod $\epsilon$=r/l where r is the length of throw of a crank arm and l is the length of the piston rod $m_3$=crank mass e=distance from the center of the crank arm axis to the center of the crank mass $m_3$ b=distance from the center of mass $m_2$ to the axis of the crank arm c=distance from the center of mass of the piston to the center of mass of the piston rod k=piston rod mass center radius of gyration.

2. An engine as defined in claim 1 in which the required crank mass balancing weight is expressed:

$$m^* = \left[\frac{m_2}{l}b + \frac{2}{a}(bc - k^2)\right]$$

where:

$m^*$=crank mass balancing weight

3. An engine as defined in claim 1 wherein the crank spacing for the engine is expressed:

$$a = \frac{2\, m_2\epsilon\, (bc - k^2)}{m_3 e - m_2 b\epsilon}.$$

4. An engine as defined in claim 1 which comprises a two cycle two cylinder simultaneously firing twin crankshaft engine.

5. An engine as defined in claim 4 and wherein the twin crankshafts are geared to a common engine output shaft, the engine being symmetrical about the axis of said output shaft.

6. An aircraft engine comprising:

(a) a generally symetrical engine block having a longitudinal axis; and a transverse axis intersecting said longitudinal axis.

(b) a pair of diametrically opposed cylinders mounted on opposite sides of said block, the centerline of said cylinders being along said transverse axis;

(c) pistons for reciprocating in said engine block;

(d) a central main output shaft journalled by said block, one end of said shaft protruding forwardly from said block, the axis of said output shaft being along said longitudinal axis;

(e) a pair of parallel crankshafts extending longitudinally within said block, said crankshafts being parallel to said output shaft and equidistand on opposite sides of said longitudinal axis;

(f) said crankshafts having crank arms within said block;

(g) piston rods connecting said pistons respectively to said crank arms;

(h) a main gear on said main output shaft;

(i) crank gears on the forward ends of said crankshafts meshing with said main gear;

(j) a thrust bearing in said block for said main shaft; and (k) means for firing said cylinder simultaneously.

(l) said crankshafts of the engines being balanced according to the formula:

$$(m_2 b\epsilon - m_3 e)a + 2m_2\epsilon(bc - k^2) = 0$$

where:

$a$ = crank spacing $m_2$ = mass of each piston rod $\epsilon = r/l$ where r is the length of throw of a crank = arm and l is the length of the piston rod $m_3$ = crank mass e = distance from the center of the crank arm axis to the center of the crank mass $m_3$ *p1 b = distance from the center of mass* $m_2$ to the axis of the crank arm c = distance from the center of mass of the piston to the center of mass of the piston rod k = piston rod mass center radius of gyration.

* * * * *